United States Patent [19]

Owens

[11] 4,408,978

[45] Oct. 11, 1983

[54] ADVANCEMENT APPARATUS FOR CONCRETE SCREED

[76] Inventor: Joe M. Owens, 16 Pebblewood Trail, Naperville, Ill. 60540

[21] Appl. No.: 309,005

[22] Filed: Oct. 6, 1981

[51] Int. Cl.[3] ..... B28B 1/08; B28B 17/00; E01C 19/38

[52] U.S. Cl. ..... 425/456; 264/69; 404/114; 404/119; 404/120

[58] Field of Search ..... 425/62, 456; 264/69; 404/114, 119, 120

[56] References Cited

U.S. PATENT DOCUMENTS

| | | | |
|---|---|---|---|
| 4,213,749 | 7/1980 | Morrison | 425/456 |
| 4,261,694 | 4/1981 | Morrison | 425/456 |
| 4,316,715 | 2/1982 | Allen | 425/456 |
| 4,335,976 | 6/1982 | Morrison | 425/456 |
| 4,340,351 | 7/1982 | Owens | 425/456 |
| 4,349,328 | 9/1982 | Allen | 425/456 |

*Primary Examiner*—Philip E. Anderson
*Attorney, Agent, or Firm*—Lee, Smith & Jager

[57] ABSTRACT

An apparatus for automatically advancing a concrete screed as the screed tamps and levels concrete. The apparatus includes cable reeling means attached to either end of the concrete screed for winding a drive cable. The drive cable is adapted for attachment to a fixed location downstream from the screed so that winding of the cable on the reeling means propels the concrete screed towards the fixed location. The cable reeling means is driven by a power transfer means including a driven pulley and a slave pulley with an endless belt loosely mounted around the pulleys so that when the driven pulley is rotated, the belt will normally not drive the slave pulley. The apparatus also includes an assembly positioned to tension the belt between the drive and slave pulleys to cause the driven pulley to drive the slave pulley through the belt, and therefore drive the cable reeling means, propelling the concrete screed across the concrete. The tensioning of the belt is adjustable so that, if desired, the belt is allowed to slip. By appropriate adjustment of the tension, the speed of propulsion of the concrete screed is controlled.

8 Claims, 4 Drawing Figures

ADVANCEMENT APPARATUS FOR CONCRETE SCREED

BACKGROUND OF THE INVENTION

This invention relates to vibratory concrete screeds and in particular to a device for automatically driving a portable screed at various propulsion speeds as the screed imparts uniform vibrations to poured concrete for tamping and levelling of the concrete as it is finished.

As related in my co-pending U.S. patent application, Ser. No. 234,348, filed Feb. 13, 1981, as labor costs continue to escalate in the building industry, builders increasingly have turned to machines which accomplish labor-intensive tasks in the least possible time in order to incur the least possible labor expense. The above-identified application, which is incorporated herein by reference, discloses an improved vibratory concrete screed which, when propelled across a freshly-poured concrete surface, automatically tamps and levels the concrete to a finished surface.

Although the concrete screed of the above-identified pending application substantially increases the productivity of concrete finishing, the screed itself is driven manually by means of a hand-cranked winch. Thus, an operator must constantly monitor the screed and continually wind the winch in order to advance the concrete screed across the concrete. Since advancement of the concrete screed depends upon the operator, and since a human operator can rarely advance the concrete screed with any degree of uniform regularity, an inexperienced operator may advance the concrete screed too fast or too slow, thus either requiring another pass across the concrete to properly finish it, or taking too much time to traverse the poured concrete. In either case, greater time than required to adequately complete the job is expended, increasing costs.

SUMMARY OF THE INVENTION

The invention automatically advances a concrete screed at a constant rate of speed as the screed tamps and levels freshly-poured concrete. The apparatus according to the invention comprises a cable reeling means attached to the concrete screed for winding a drive cable thereupon. The cable is adapted for attachment to a fixed location such that winding of the cable on the reeling mean propels the concrete screed toward the fixed location. The apparatus also includes power transfer means connected to the driven shaft of the concrete screed and to the cable reeling means for imparting power from the driven shaft to the cable reeling means. The power transfer means has a driven pulley and a slave pulley with an endless belt loosely mounted about the pulleys such that rotation of the driven pulley normally will not drive the belt. In order to drive the belt and therefore drive the slave pulley through the belt, the apparatus includes an assembly positioned to tension the belt between the pulleys.

In accordance with the preferred embodiment, the cable reeling means includes a spool upon which the drive cable is wound and gear means for rotating the spool, the gear means being connected to the slave pulley to be driven thereby. The cable reeling means also includes means to disengage the gear means to allow free rotation of the spool in order to permit the cable to be payed out and attached to a fixed location.

The drive pulley is rotatably attached to the concrete screed. In accordance with the disclosed embodiment, the power transfer means includes a second endless belt drivingly interconnecting the driven shaft of the concrete screed and the drive pulley. Thus, the drive pulley is isolated by the second endless belt from direct vibration of the driven shaft, but is driven thereby.

The tension means includes a lever arm pivotally attached at one end to the concrete screed. The lever arm has a pressure applicator adjacent to the endless belt for engaging the belt and applying tension to the belt when the lever arm is pivoted toward the belt into an actuation position. In addition, the tension means includes means for maintaining the lever arm in a rest position with the pressure applicator out of engagement with the belt. Thus, when the lever arm is in its normal rest position, the screed is not driven, even if the driven vibratory shaft of the concrete screed is being rotated.

The tension means also includes a stop for maintaining the lever arm in the actuation position with the pressure applicator in engagement with the endless belt. The stop can be adjusted toward and away from the belt in order to alter the tension applied to the belt by the pressure applicator when the lever arm is in the actuation position. Depending on the tension applied, the belt can slip, thus permitting the screed to be propelled at various velocities without dependence solely upon the rotational velocity of the driven shaft of the concrete screed.

Normally, one of the automatic advancing apparatuses is mounted at either end of the concrete screed. However, depending upon the length of the screed and the task that the screed is to perform, any number of the automatic advancing apparatuses can be employed as required.

BRIEF DESCRIPTION OF THE DRAWINGS

The invention is set forth in greater detail in the following description of the preferred embodiment, taken in conjunction with the drawings, in which:

FIG. 4 is an enlarged perspective view of the adjustable stop for the lever arm.

DESCRIPTION OF THE PREFERRED EMBODIMENT

Figure 1:
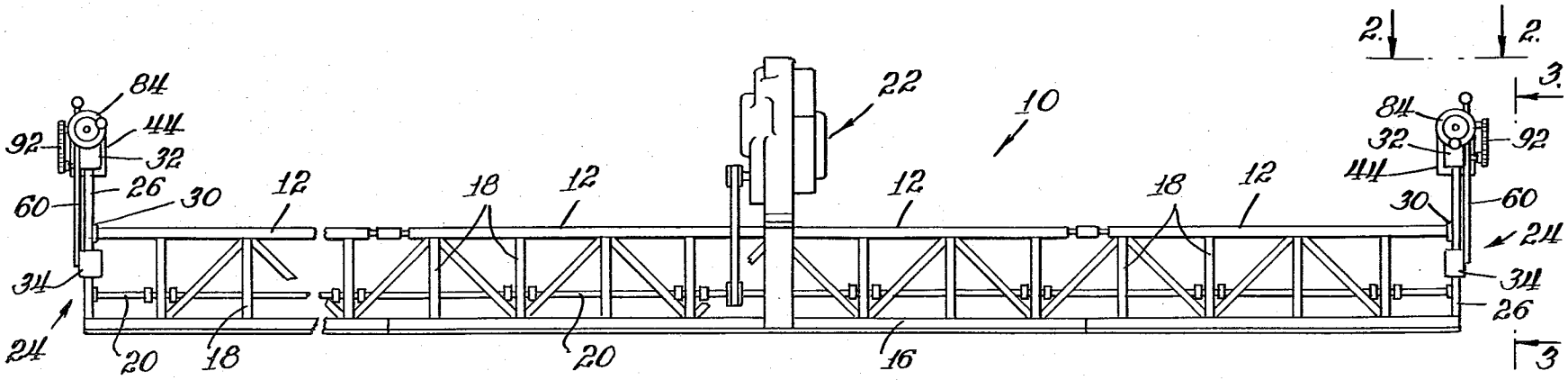
FIG. 1 is a rear elevational illustration of a concrete screed employing an automatic advancing apparatus according to the invention at either end of the screed.
Figure 11:
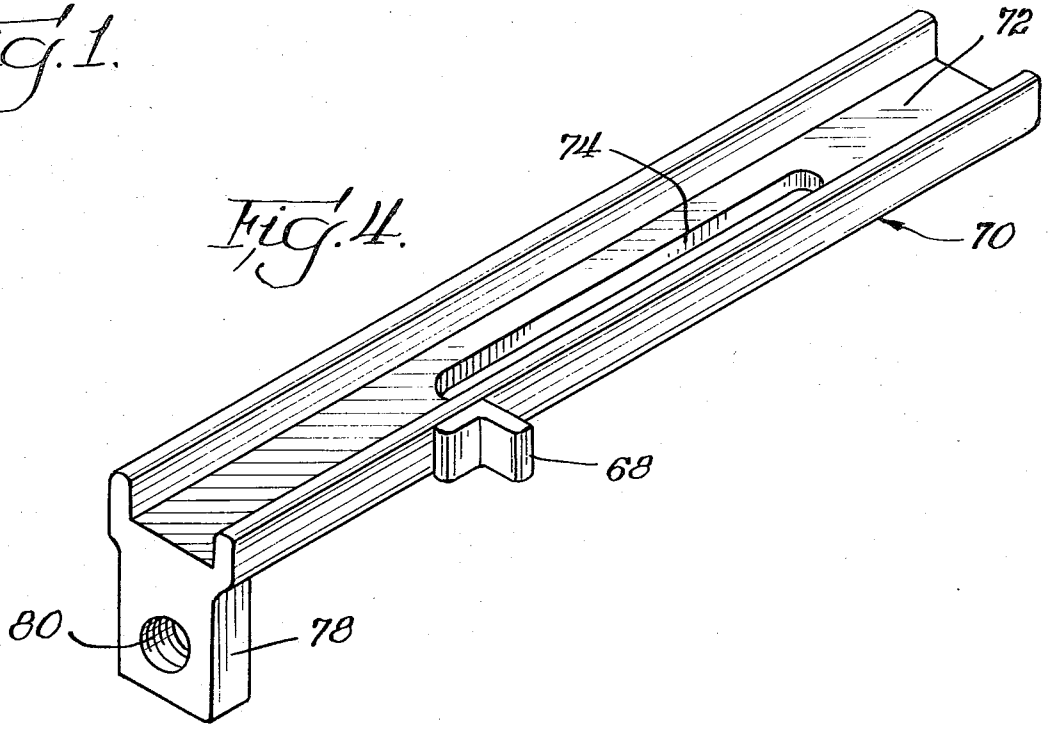

A concrete screed employing the automatic advancing apparatus according to the invention is schematically illustrated at 10 in FIG. 1. The screed may be conventional or, as shown, may be constructed in accordance with referenced application Ser. No. 234,348, from which an explanation of the screed in greater detail may be obtained.

The screed 10 is composed of a series of frame units 12 which have been connected to form the screed 10 in a modular fashion. The frame units 12 are adjustable in their interconnection so that the screed can be bowed in a convex fashion to smooth poured concrete with a crown, or so that the screed can be formed in a concave fashion to permit finishing of poured concrete with a swirl, or with the frame units in alignment so that the poured concrete is finished with a flat surface.

Each of the frame units 12 has a pair of spaced-apart elongate screed plates 14 and 16 for working concrete as the screed 10 is drawn across the poured concrete. As described in detail in referenced application Ser. No. 234,348, each of the frame units 12 also has a series of spaced, parallel unitary frame members or A-frames 18 of triangular configuration which interconnect the screed plates 14 and 16.

Each of the frame units 12 has an eccentric shaft 20 which is journalled for rotation in a series of bearings in certain of the A-frames 18. The shaft 20 is driven by a motor 22 mounted on one of the frame units 12. A more detailed description of the screed 10 is found in the above-referenced application.

Figure 2:
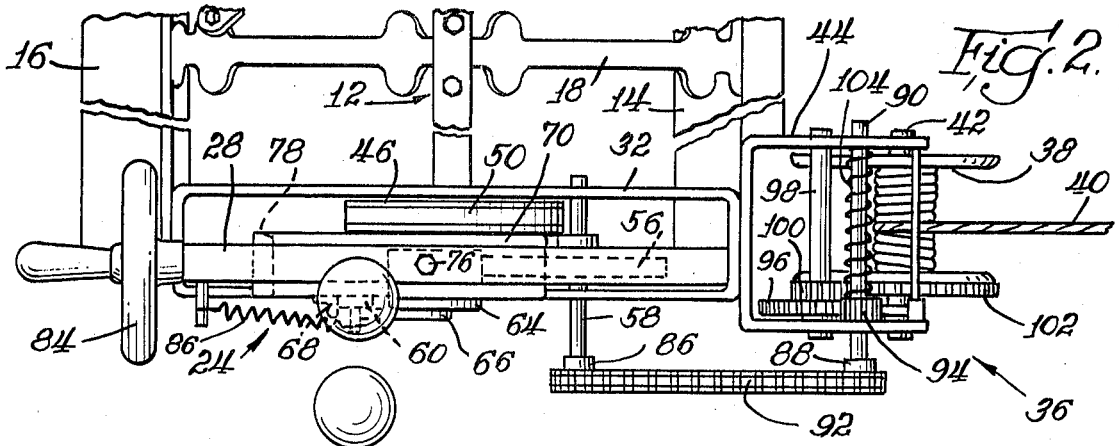
FIG. 2 is an enlarged top plan illustration taken along lines 2—2 of FIG. 1.
Figure 3:
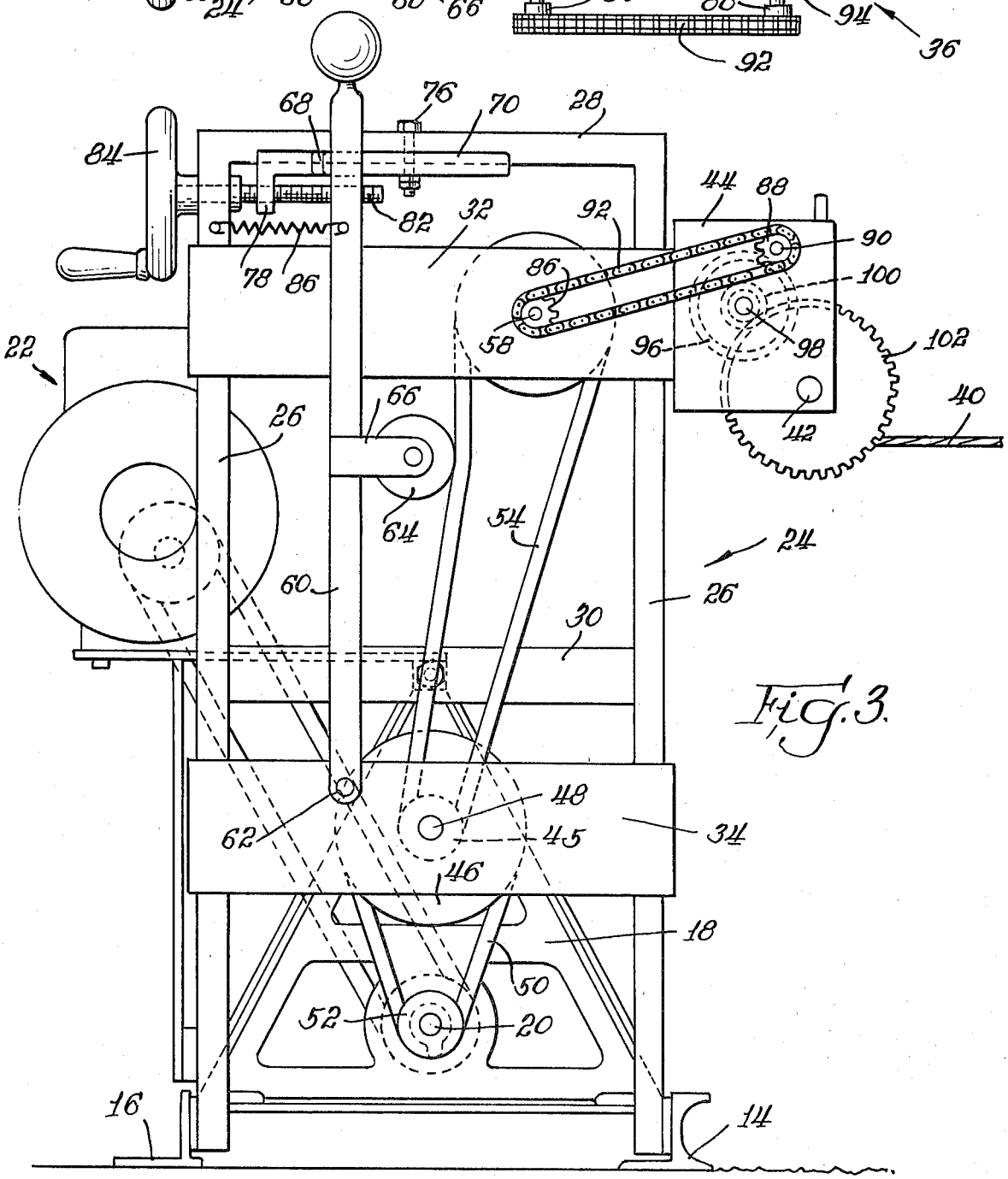
FIG. 3 is an enlarged side elevational illustration taken along lines 3—3 of FIG. 1.

An end section 24 which includes the apparatus for propelling the screed 10 across poured concrete is located at each end of the screed 10. As best illustrated in FIGS. 2 through 4, each end section 24 has upright frame members 26 bolted to the respective screed plates 14 and 16, and a top frame member 28. A cross brace 30 is positioned at the altitute of the top of the adjacent frame unit 12 and is attached to the top of the frame unit so that the end section 24 is affixed to the frame unit 12 at three locations, at each of the screed plates 14 and 16 and at the top of the frame unit.

The end section 24 includes a pair of mounting plates 32 and 34 secured about the upright frame members 26. As best shown in FIG. 2, the mounting plate 32 (the mounting plate 34 being identical thereto) extends about the frame members 26 in an open, rectangular fashion for support of pulleys and other portions of the automatic screed advancing apparatus as described in greater detail below.

A cable reeling means 36 is attached to the top mounting plate 32. The reeling means 36 includes a spool 38 upon which a drive cable 40 is wound. The spool 38 is mounted for rotation about a central axle 42 which is secured between the legs of a U-shaped bracket 44 affixed to the mounting plate 32.

Although means of joining the upright frame members 26, the top frame member 28, the cross brace 30, the mounting plates 32 and 34, and the U-shaped bracket 44 are not illustrated, it should be evident that these elements, all typically being fabricated of metal, can be welded, bolted, or otherwise joined as required.

As shown in FIGS. 2 and 3, a pulley 46 is mounted within the mounting plate 34, the pulley 46 being rotatable on an axle 48 affixed at its ends to the mounting plate 34. The pulley 46 is driven by a belt 50 passing over a pulley 52 secured to the eccentric shaft 20. Thus, whenever the shaft 20 is driven by the motor 22, the belt 50 will drive the pulley 46.

The pulley 46 also is formed to drive a belt 54 which is connected between a small diameter wheel 45 of the pulley 46 and a slave pulley 56 which is mounted for rotation on an axle 58 secured within the upper mounting plate 32. The belt 54 is loosely mounted about the pulleys 46 and 56 such that the pulley 46, when driven, normally will not drive the belt 54, and therefore the pulley 56 remains stationary. When the belt 54 is tensioned sufficiently, however, frictional engagement of the belt 54 with the pulleys 46 and 56 creates a driving engagement between the two pulleys. Depending upon the amount of tension, the belt 54 will slip as the pulley 46 is rotated, therefore driving the pulley 56 at a slower rate than if slippage did not occur. When the belt 54 is tensioned sufficiently, however, it does not slip and the speed relationship between the pulleys 46 and 56 is therefore determined by the diameters of the pulley wheels over which the belt 54 passes.

To tension the belt 54, the end section 24 includes an upright lever arm 60 pivotally attached at its lower end by a pin 62 to the lower mounting plate 34. The lever arm 60 includes a pressure applicator in the form of a wheel 64 rotatably secured within a bracket 66 affixed to the lever arm 60. In the position shown in FIGS. 2 and 3, the wheel 64 is in alignment with the belt 54 and engages the belt 54 for applying tension to the belt in order that the belt 54 may drive the pulley 56 when the pulley 46 is driven.

The lever arm 60 is pivotally held by a stop 68 in the actuation position with the wheel 64 in engagement with the belt. The stop 68 in turn is secured to a slide bracket 70 mounted beneath the top frame member 28. As best shown in FIG. 4, the bracket 70 includes a longitudinal channel 72 shaped to engage the underside of the top frame member 28. The bracket 70 also includes an elongated slot 74 which, when the bracket 70 is mounted beneath the top frame member 28, is engaged by a bolt 76 passing through the top member 28 (FIG. 3). The bolt 76 serves to guide and clamp the bracket 70 to the top member 28.

The slide bracket 70 also includes a downwardly depending leg 78 having an internally threaded aperture 80 therethrough. When the bracket 70 is mounted beneath the top frame member 28, the threaded aperture 80 is engaged by a threaded rod 82 which is secured for rotation in the left upright frame member 26 (FIG. 3). The threaded rod 82 passes through the frame member 26 and a hand wheel 84 is secured to that portion passing through the frame member 26.

Since the leg 78 is threadedly engaged on the rod 82, and since the rod 82 is fixed for rotation within the frame member 26, rotation of the hand wheel 84 will displace the slide bracket 70 longitudinally along the top frame member 28. Thus, the position of the stop 68 is adjustable by rotation of the hand wheel 84. This in turn adjusts the pivoted actuation position of the lever arm 60, therefore adjusting the tension applied by the wheel 64 to the belt 54. As a consequence, the amount of slippage of the belt 54, if any, when the lever arm 60 is in the actuation position is controlled by rotation of the hand wheel 84.

When the concrete screed 10 is not to be driven, even if the shaft 20 is rotating, the lever arm 60 is held in a rest position with the pressure application wheel 64 out of engagement with the belt 54. As shown in FIG. 3, a spring 86, extended when the lever arm 60 is in the illustrated actuation position, draws the lever arm 60 to the left and will, when the lever arm is out of engagement with the stop 68, maintain the lever arm in a rest position with the wheel 64 out of the driving engagement with the belt 54.

As shown in FIGS. 2 and 3, the slave pulley 56 drives the spool 38 through a chain and a series of gears. A sprocket 86 is secured on the axle 58 in alignment with a sprocket 88 secured on an axle 90 passing through and rotatable within the U-shaped bracket 44. A chain 92 transmits driving rotation of the sprocket 86 to the sprocket 88 and axle 90. A gear 94 is also secured to the axle 90 and engages a gear 96 secured to an axle 98 rotatably mounted within the U-shaped bracket 44. A second gear 100 is also secured to the axle 98 and engages a gear 102 attached to the spool 38. Thus, when the pulley 56 is rotated, rotation is transmitted by the chain 92 to the spool 38 through the gear train comprising the gears 94, 96, 100 and 102. Thus, the spool 38 is rotated whenever the slave pulley 56 is driven.

As shown in FIG. 2, a compressed spring 104 is situtated on the axle 90, bearing against one leg of the U-shaped bracket 44 and against the gear 94. Thus, the gear 94 is normally held by the spring 104 against the opposite leg of the U-shaped bracket 44 and in engagement with the gear 96.

The drive cable 40 must be initially payed out from the spool 38 to a downstream fixed location. To disengage the spool 38 to permit free rotation of the spool, the user applies pressure to the sprocket 88 toward the U-shaped bracket 44. The pressure compresses the spring 104, disengaging the gear 94 from the gear 96, and therefore permitting free rotation of the spool 38. After a sufficient length of the drive cable 40 is unwound from the spool 38, pressure is released from the sprocket 88, permitting the spring 104 to urge the gear 94 into reengagement with the gear 96.

ACHIEVEMENTS

The unique drive according to the invention automatically advances a concrete screed at any one of an infinitely variable variety of speeds. When the lever arm 60 is engaged against the stop 68 and the drive wheel 64 is therefore pressing against the belt 54, rotation of the shaft 20 will, through the power transfer train described above, rotate the spool 38, rewinding the drive cable 40 and therefore propelling the screed 10 across the concrete being treated. Since the tension applied by the wheel 64 to the belt 54 is variable, the drive speed of the screed 10 is infinitely variable between a rest speed and a speed when there is no slippage of the belt 54 on the pulley 46 or the pulley 56. Therefore, the screed operator can readily adjust the screed speed as desired to effect adequate and complete tamping and leveling of the concrete being worked. With an operator at either end of the screed 10, adjustment of the hand wheels 84 may be made in unison to "fine tune" the screed to assure that both ends of the screed 10 are driven at the same velocity.

Various changes may be made to the invention without departing from the spirit thereof or scope of the following claims.

What is claimed is:

1. An apparatus for automatically advancing a concrete screed as the screed tamps and levels concrete, the screed having a driven shaft for imparting vibrations to the concrete, comprising a. cable reeling means attached to the concrete screed for winding a drive cable thereupon, the cable being adapted for attachment to a fixed location such that winding of cable on said reeling means propels the concrete screed toward the fixed location, b. power transfer means connected to the driven shaft and said cable reeling means for imparting power from said driven shaft to said cable reeling means, said power transfer means including a driven pulley drivingly attached to said driven shaft and a slave pulley drivingly attached to said cable reeling means, and an endless belt loosely mounted about said pulleys such that said driven pulley normally will not drive said belt, and c. means to tension said belt between said pulleys to cause said driven pulley to drive said slave pulley through said belt.

2. The apparatus according to claim 1 in which said cable reeling means includes a spool upon which said drive cable is wound and gear means for rotating said spool, said gear means being connected to said slave pulley.

3. The apparatus according to claim 2 including means to disengage said gear means to permit free rotation of said spool.

4. The apparatus according to claim 1 in which said driven pulley is rotatably attached to the concrete screed and in which said power transfer means includes a second endless belt drivingly interconnecting said driven shaft and said driven pulley.

5. The apparatus according to claim 1 in which said tension means includes a lever arm pivotally attached at one end to the concrete screed, said lever arm having a pressure applicator adjacent said endless belt for engaging and applying tension to said belt when said lever arm is pivoted, and further including means for maintaining said lever arm in a rest position with said pressure applicator out of engagement with said belt.

6. The apparatus according to claim 5 including a stop for maintaining said lever arm in an actuation position with said pressure applicator in engagement with said belt.

7. The apparatus according to claim 6 including means for adjusting said stop toward and away from said belt to alter the tension applied to said belt by said pressure applicator when said lever arm is in the actuation position.

8. The apparatus according to claim 1 including a said cable reeling means at each end of the concrete screed.

* * * * *